US012336632B2

(12) United States Patent
Schumacher

(10) Patent No.: US 12,336,632 B2
(45) Date of Patent: Jun. 24, 2025

(54) STADIUM SEAT

(71) Applicant: Learfield Amplify Seating, LLC, Winston-Salem, NC (US)

(72) Inventor: Jeffrey Schumacher, Port Washington, WI (US)

(73) Assignee: Learfield Amplify Seating, LLC, Winston-Salem, NC (US)

( * ) Notice: Subject to any disclaimer, the term of this patent is extended or adjusted under 35 U.S.C. 154(b) by 163 days.

(21) Appl. No.: 18/330,014

(22) Filed: Jun. 6, 2023

(65) Prior Publication Data

US 2024/0108137 A1 Apr. 4, 2024

Related U.S. Application Data

(60) Provisional application No. 63/412,708, filed on Oct. 3, 2022.

(51) Int. Cl.

| | |
|---|---|
| ***A47C 1/16*** | (2006.01) |
| ***A47C 7/44*** | (2006.01) |
| *A47C 1/026* | (2006.01) |

(52) U.S. Cl.

CPC ..... *A47C 1/16* (2013.01); *A47C 7/44* (2013.01); *A47C 7/443* (2013.01); *A47C 7/444* (2018.08); *A47C 7/445* (2013.01); *A47C 1/026* (2013.01)

(58) Field of Classification Search

CPC ..... A47C 7/44; A47C 7/443; A47C 7/444; A47C 7/445; A47C 1/16; A47C 1/026; A47C 1/0246; A47C 1/023

USPC ..... 297/291, 296, 301.3, 301.5, 337, 354.1, 297/118.5

See application file for complete search history.

(56) References Cited

U.S. PATENT DOCUMENTS

| | | | | | |
|---|---|---|---|---|---|
| 116,934 | A * | 7/1871 | Cutter | A47C 1/16 | 297/352 |
| 2,092,666 | A * | 9/1937 | Adolph | A47C 1/16 | 297/252 |
| 2,475,962 | A * | 7/1949 | Horn | A47C 1/16 | 297/252 |
| 2,509,420 | A * | 5/1950 | Burch | A47C 1/16 | 297/252 |
| 2,545,840 | A * | 3/1951 | Browne | A47C 1/16 | 297/252 |

(Continued)

FOREIGN PATENT DOCUMENTS

| | | | | |
|---|---|---|---|---|
| WO | WO-9604824 A1 * | 2/1996 | ..... | A47C 1/16 |

OTHER PUBLICATIONS

Images of various stadium seating devices, publicly available as early as Sep. 27, 2022, (3 pages).

*Primary Examiner* — Robert Canfield
(74) *Attorney, Agent, or Firm* — Michael Best & Friedrich LLP

(57) ABSTRACT

A stadium seat includes a mounting base configured to be connected to a support structure, a vertical support extending upwardly from the mounting base, a seat support movably coupled to the mounting base, and a back support coupled to the vertical support. The seat support is movable relative to the mounting base between a first position, in which the seat support is at a first horizontal distance from the vertical support, and a second position, in which the seat support is at a second horizontal distance from the vertical support, the first distance being different than the second distance.

20 Claims, 17 Drawing Sheets

(56) References Cited

U.S. PATENT DOCUMENTS 2,694,441 A * 11/1954 Degenfelder ..... A47C 1/16 297/252
2,957,515 A * 10/1960 Gibson ..... A47C 1/16 297/440.11
3,066,980 A * 12/1962 Clute ..... A47C 1/16 297/352
3,821,825 A * 7/1974 Bailey ..... B63B 29/04 297/252
3,994,529 A * 11/1976 Lippert ..... A47C 1/16 297/134
4,045,834 A * 9/1977 Mason ..... A47C 1/16 297/352
4,165,900 A * 8/1979 Pesiri ..... A47C 1/026 297/301.7
4,432,525 A * 2/1984 Duvall ..... B63B 29/04 248/287.1
4,802,708 A * 2/1989 Vos ..... B63B 29/04 248/316.4
5,042,875 A * 8/1991 Biggs, Sr. ..... A47C 1/16 297/382
5,452,937 A * 9/1995 Piretti ..... A47C 4/03 297/301.4
5,590,619 A * 1/1997 Meador ..... B63B 29/06 248/500
6,053,574 A * 4/2000 Opsvik ..... A47C 3/026 297/303.2
6,352,306 B1 * 3/2002 Dreiling ..... A47C 1/16 297/252
6,502,902 B1 * 1/2003 Romero ..... A47C 1/16 297/352
7,159,293 B2 1/2007 Coffield et al.
7,303,235 B1 * 12/2007 Fongers ..... A47C 1/16 52/9
7,647,714 B2 1/2010 Coffield et al.
7,722,117 B2 * 5/2010 Jones ..... A47C 1/16 297/230.11
7,980,192 B2 * 7/2011 Flynn ..... B63B 29/04 297/250.1
8,272,692 B1 * 9/2012 Epperson ..... A47C 1/03283 297/297
8,282,166 B2 * 10/2012 Piretti ..... A47C 7/445 297/301.1
10,694,851 B2 * 6/2020 Zhu ..... A47C 1/16
11,241,095 B1 * 2/2022 Sun ..... A47C 4/06
D1,020,342 S * 4/2024 Wood ..... D6/716
2005/0280301 A1 * 12/2005 Freed ..... A47C 1/023 297/337
2006/0220428 A1 * 10/2006 Vestweber ..... A47C 1/16 297/352
2009/0212614 A1 * 8/2009 Isaac ..... A47C 1/16 297/252
2010/0164266 A1 * 7/2010 Walters ..... B60N 2/666 297/354.11
2011/0025109 A1 2/2011 Ryczek et al.
2014/0246890 A1 * 9/2014 Lee ..... A61F 5/00 297/337
2017/0164743 A1 * 6/2017 Head, Jr. ..... A47C 7/543
2019/0231074 A1 * 8/2019 Grace ..... A45F 3/14
2021/0321776 A1 * 10/2021 Plant ..... A47C 7/444
2022/0232982 A1 * 7/2022 Greaney ..... A47C 7/5062
2023/0020288 A1 * 1/2023 Galiotto ..... A47C 1/024
2024/0341480 A1 * 10/2024 Davis ..... A47C 7/407

* cited by examiner

STADIUM SEAT

CROSS-REFERENCE TO RELATED APPLICATION

This application claims priority to U.S. Provisional Application No. 63/412,708, filed on Oct. 3, 2022, the entire contents of which is incorporated herein by reference.

FIELD OF INVENTION

The present invention relates to seats and, more particularly, to stadium seats used with bleachers.

BACKGROUND OF THE INVENTION

Various types of stadium seats that attach to bleachers are known. Conventional stadium seats, however, are typically not adjustable and not very comfortable to a user.

SUMMARY OF THE INVENTION

The present invention provides, in one aspect, a stadium seat including a mounting base configured to be connected to a support structure, a vertical support extending upwardly from the mounting base, a seat support movably coupled to the mounting base, and a back support coupled to the vertical support. The seat support is movable relative to the mounting base between a first position, in which the seat support is at a first horizontal distance from the vertical support, and a second position, in which the seat support is at a second horizontal distance from the vertical support, the first distance being different than the second distance.

The present invention provides, in one aspect, a stadium seat including a mounting base configured to be connected to a support structure, a vertical support extending upwardly from and pivotably coupled to the mounting base by a pivot pin, a seat support coupled to the mounting base, and a back support coupled to the vertical support. The vertical support is pivotable relative to the mounting base between a neutral position and a reclined position.

The present invention provides, in another aspect, a stadium seat including a mounting base configured to be connected to a support structure, and a seat support coupled to the mounting base. The mounting base includes a front hook configured to engage a first edge of the support structure and a rear hook configured to engage a second edge of the support structure. The rear hook is movable relative to the front hook between a first position, in which the rear hook is spaced a first distance from the front hook, and a second position, in which the rear hook is spaced a second distance from the front hook, the first distance being less than the second distance.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-9 illustrate a stadium seat 10 according to an exemplary embodiment of the present disclosure. The stadium seat 10 is configured to attach to, for example, a bleacher 12 (shown in FIG. 1A) in a stadium to designate a seating area and provide increased comfort for a user. The stadium seat 10 could also attach to bleachers, benches, or other suitable support structures in other settings. In some scenarios, the stadium seat 10 may semi-permanently attach to the bleacher 12 such that that a tool or special operation is required to remove the stadium seat 10 from the bleacher 12. In other scenarios, the stadium seat 10 may be more easily attachable and removable from the bleacher 12 such that a user can quickly connect and disconnect the stadium seat 10 from the bleacher 12.

Figure 1A:
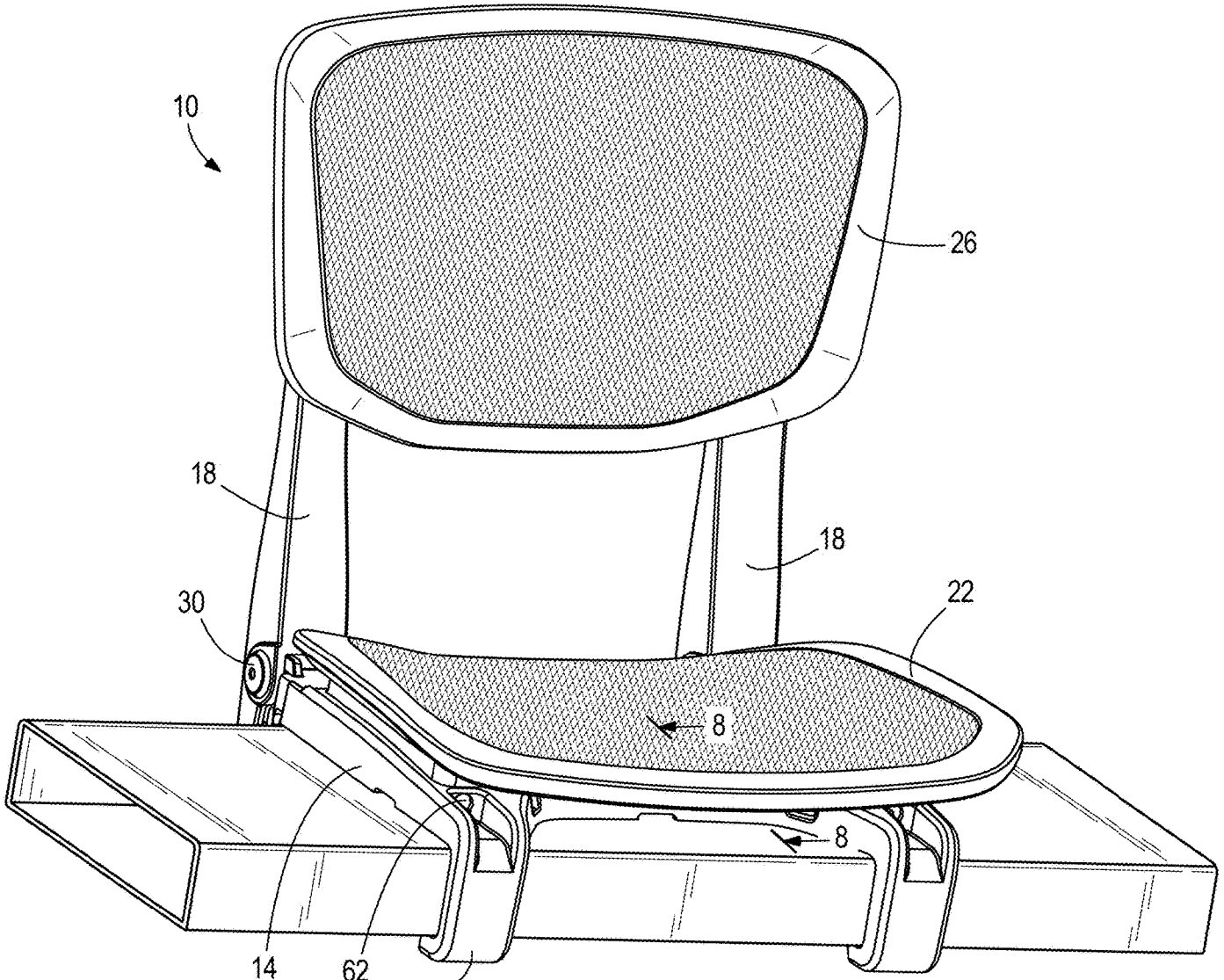
FIG. 1A is a perspective view of a stadium seat according to an embodiment of the invention.
Figure 1B:
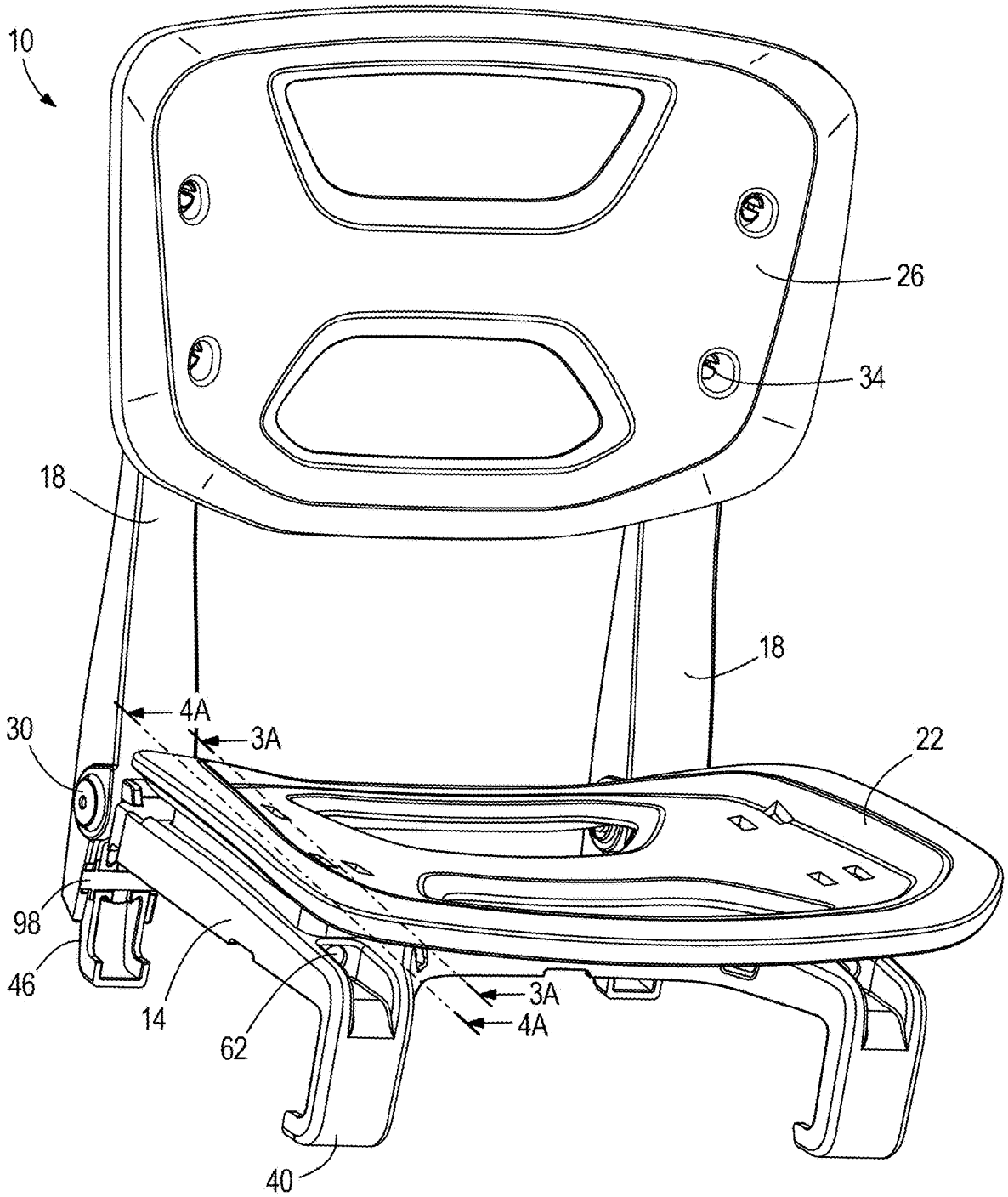
FIG. 1B is a perspective view of the stadium seat of FIG. 1A with a mesh material removed.
Figure 1C:
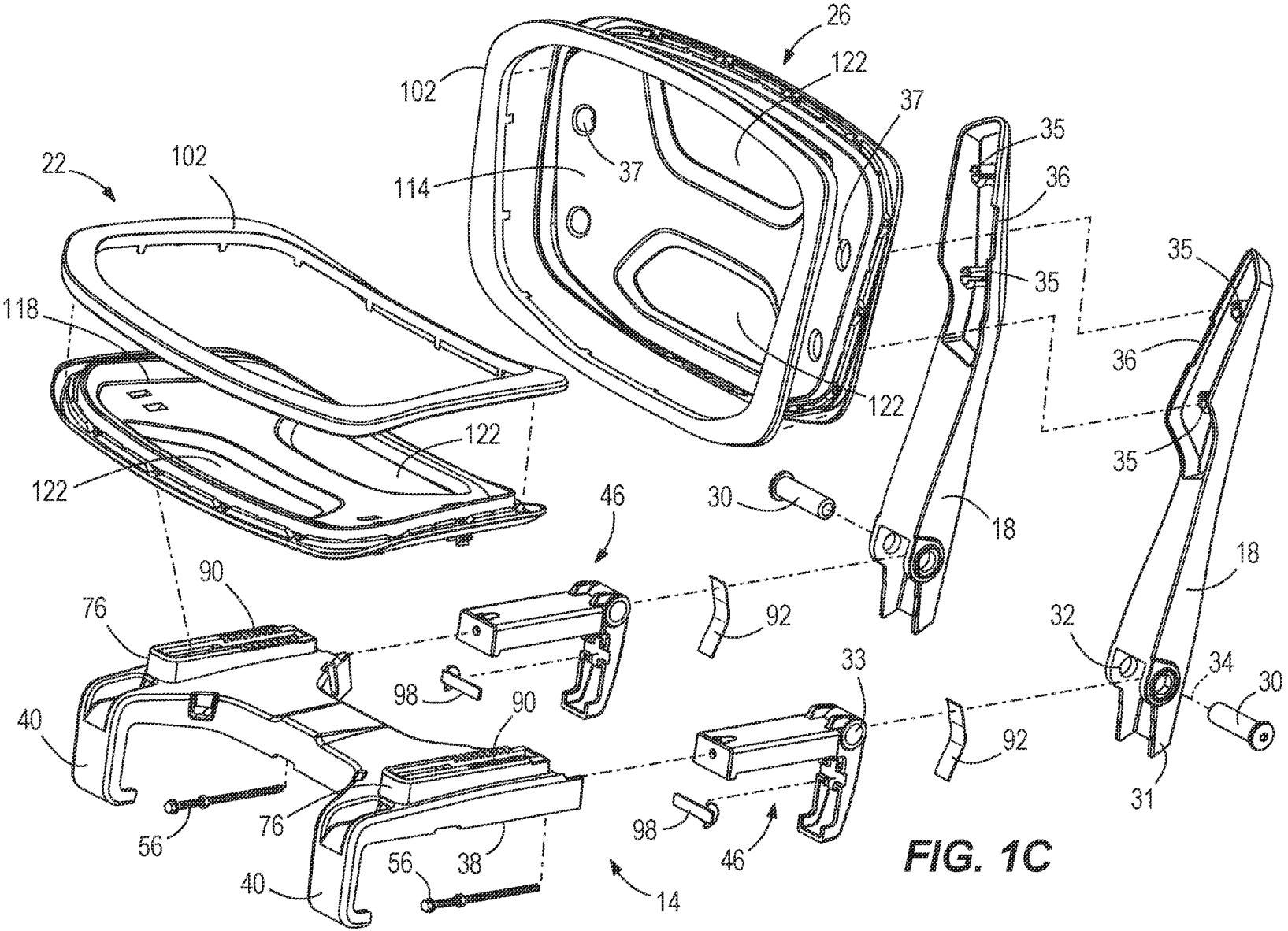
FIG. 1C is an exploded perspective view of the stadium seat of FIG. 1B.

With reference to FIGS. 1A-1C, the illustrated stadium seat 10 includes a mounting base 14, one or more vertical supports 18 coupled to the mounting base 14, a seat support 22 movably coupled to the mounting base 14, and a back support 26 coupled to the vertical support 18. The vertical supports 18 are coupled to the mounting base 14 via corresponding pins 30 disposed near a first end of the vertical support 18 such that the vertical supports 18 extend upwardly from the mounting base 14. The pins 30 extend through a vertical support aperture 32 in the vertical support 18 and a mounting base aperture 33 in the mounting base 14. In other embodiments, the vertical supports 18 may be coupled to the mounting base 14 via fasteners, snap-fits, or the like. The pins 30 allow the vertical supports 18 to be removed from the mounting base 14 such that stadium seat 10 can only include the seat support 22 without the back support 26.

To couple the vertical supports 18 to the mounting base 14, the mounting base aperture 33 is placed in a center portion of the vertical support aperture 32 such that a center axis of the mounting base aperture 33 is coaxial with a center axis of the vertical support aperture 32. The pin 30 is then inserted into the vertical support aperture 32 and the mounting base aperture 33 along a pin axis 34. The pin axis 34 is coaxial with the center axes of the vertical support aperture 32 and the mounting base aperture 32. The pin axis 34 is perpendicular with the vertical supports 18. The pins 30 can be installed and removed from either side of the stadium seat 10 in case one side of the stadium seat 10 is up against, for example, a wall. In some embodiments, the stadium seat 10 includes two vertical supports 18. In other embodiments, the stadium seat 10 includes more than or less than two vertical supports 18.

The back support 26 is coupled to the vertical supports 18 via barbs 35. In other embodiments, the back support 26 may be coupled to the vertical supports 18 via snap-fits, fasteners, or the like. Specifically, each of the vertical supports 18 includes a back mount 36 disposed near a second end of the vertical support 18, the second end being opposite to the first end. The back mount 36 defines a width that is larger than a width defined by the remainder of the vertical support 18. Two of the barbs 35 are positioned in the back mount 35 of each vertical support 18. In other embodiments, less than or more than two barbs 35 may be included. Each of the barbs 35 interacts with an aperture 37 disposed on the back support 26 to hold the back support 26 to the vertical support 18. When the barbs 35 hold the back support 26 to the vertical support 18, a surface of the back support 26 rests on the back mount 36.

Figure 2:
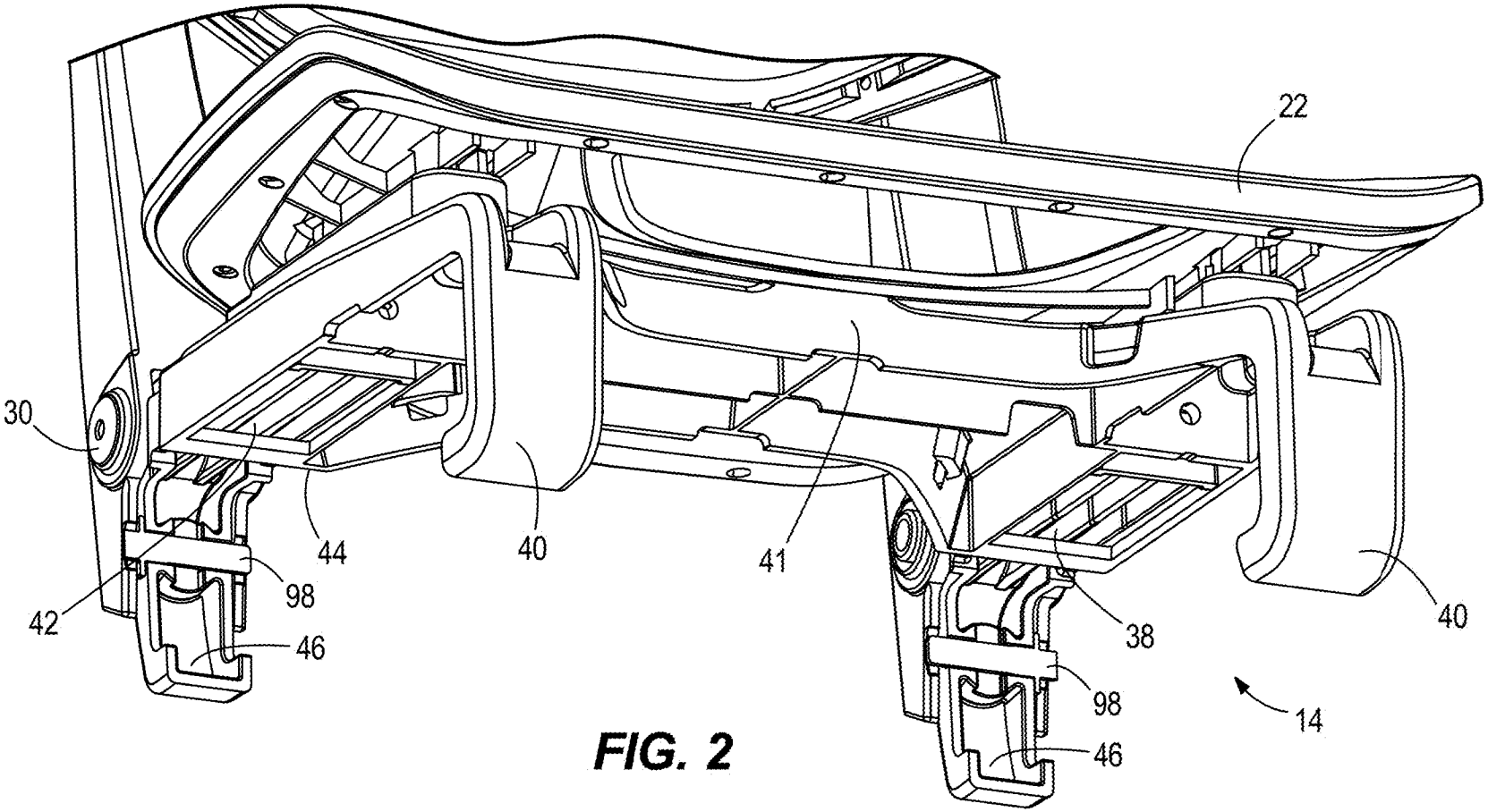
FIG. 2 is a bottom perspective view of a portion of the stadium seat of FIG. 1.
Figure 3A:
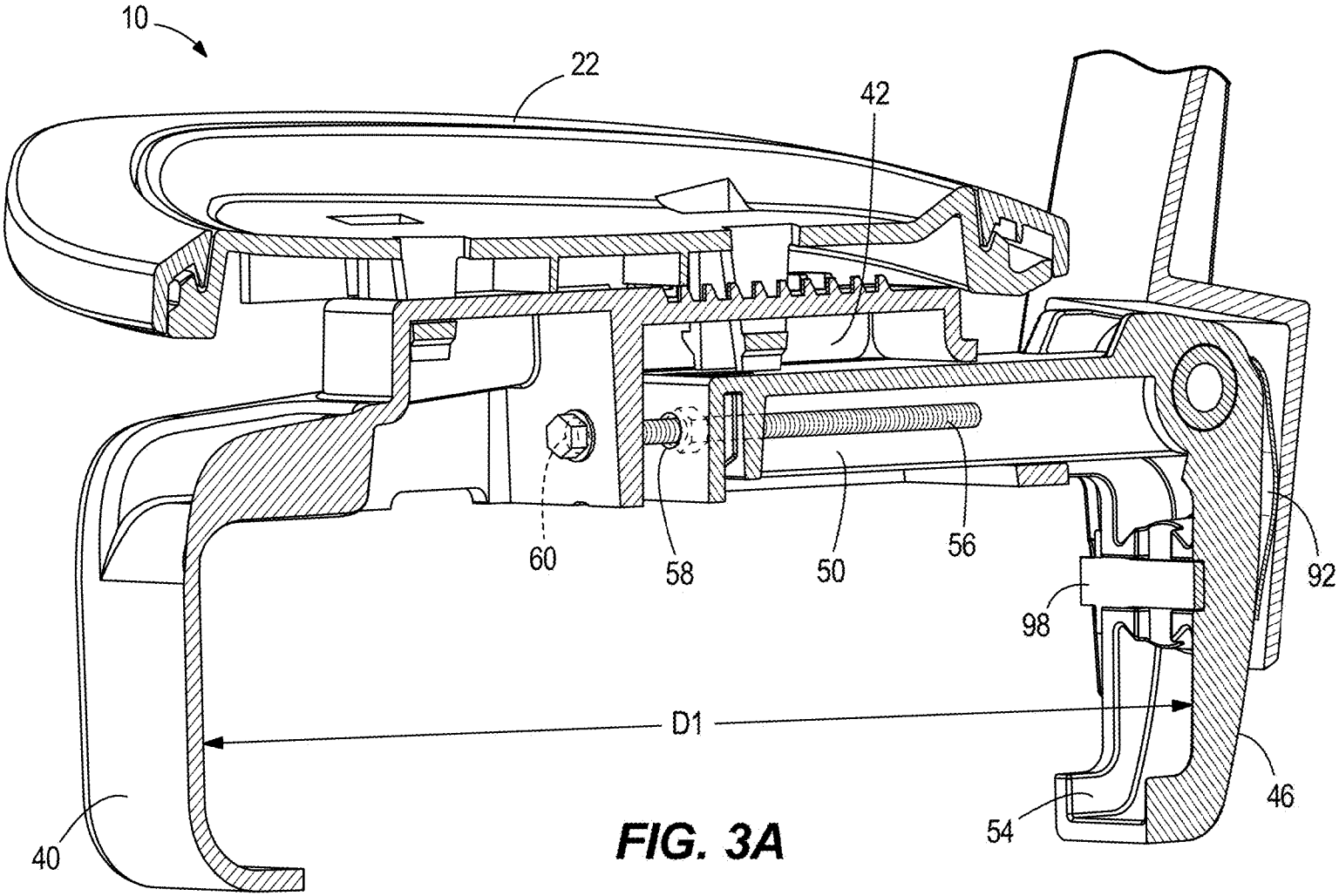
FIG. 3A is a cross-sectional, perspective view of the stadium seat taken along section line 3A-3A of FIG. 1B in a first position.
Figure 3B:
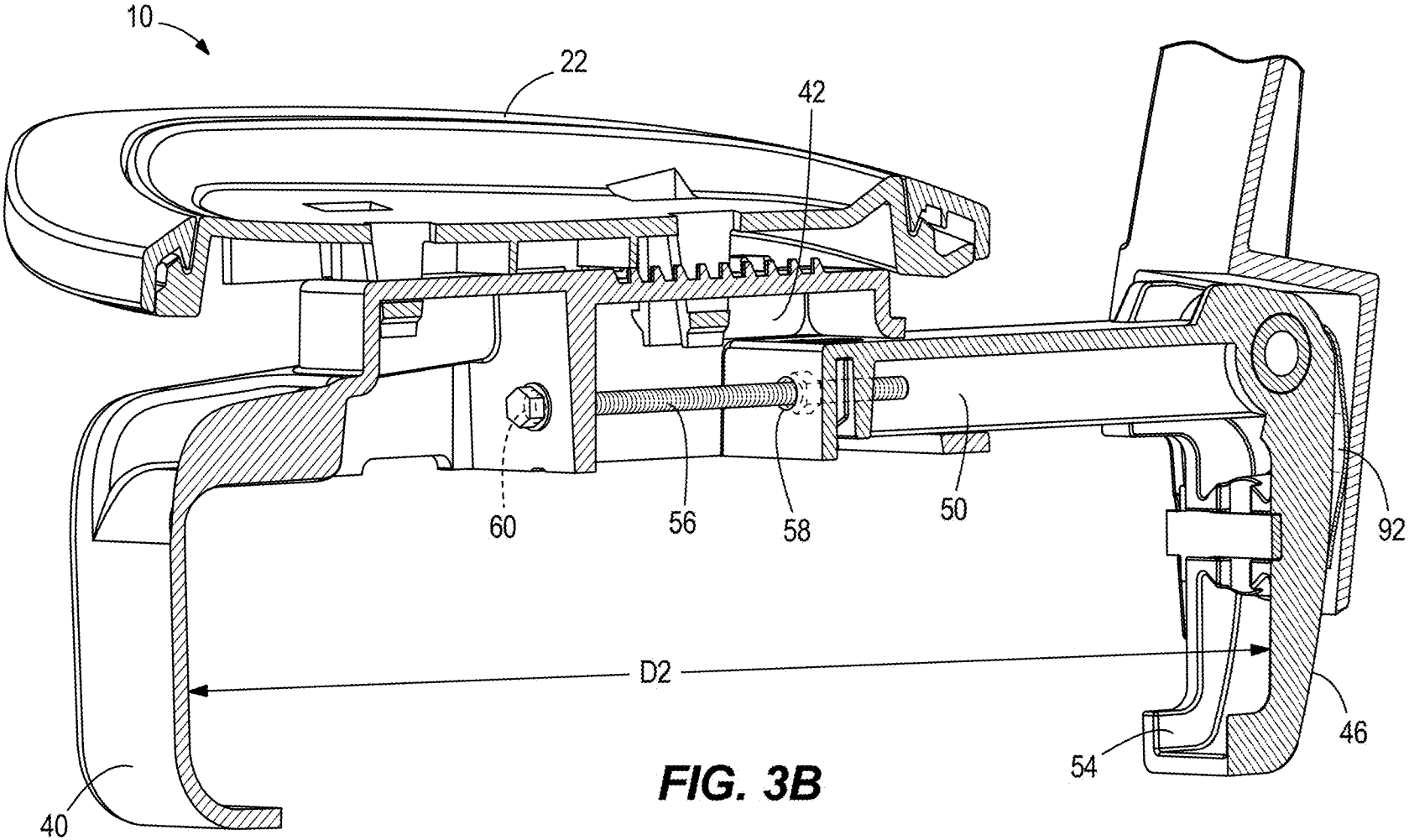
FIG. 3B is a cross-sectional, perspective view of the stadium seat taken along section line 3A-3A of FIG. 1B in a second position.

With reference to FIGS. 2-3B, the mounting base 14 includes a body 38, front hooks 40 positioned on a front end 41 of the body 38, and rear hooks 46 received in slots 42 disposed at a back end 44 of the body 38. The front hooks 40 are positioned on opposite corners of the front end 41. In some embodiments, the body 38 includes two front hooks 40. In other embodiments, the body 38 includes more than or less than two front hooks 40. The front hooks 40 extend downwardly, away from the body 38. The front hooks 40 have a cross-sectional shape that is generally U-shaped. The front hooks 40 are integrally formed with the body 38. In other embodiments, the front hooks 40 may be coupled to the body 38 via fasteners, snap-fits, or the like. The slots 42 are positioned on opposite corners of the back end 44 of the body 38. In some embodiments, the body 38 includes two slots 42. In other embodiments, the body 38 may include more than or less than two slots 42. Each of the slots 42 is sized to receive one of the rear hooks 46. Specifically, each slot 42 is configured to receive a leg 50 of one of the rear hooks 46. When the leg 50 is received in the slot 42, a hook portion 54 of the rear hook 46 extends downward, away from the body 38. The hook portion 54 has a cross-sectional shape that is generally U-shaped. In some embodiments, the hook portion 54 is integrally formed with the leg 50. In other embodiments, the hook portion 54 may be coupled to the leg 50 via a fastener, welding, snap-fits, or the like.

The rear hook 46 is movable relative to the slot 42 to increase a space between the front hook 40 and the rear hook 46 and allow the front and rear hooks 40, 46 to clamp onto the bleacher 12. For example, the hook portion 54 is movable between a first position (shown in FIG. 3A), in which the hook portion 54 is at a first distance D1 relative to the front hook 40, and a second position (shown in FIG. 3B), in which the hook portion 54 is at a second distance D2 relative to the front hook 40, the first distance D1 being less than the second distance D2. The rear hook 46 is coupled to the slot 42 via a fastener 56 that extends through a leg aperture 58 in the leg 50 and a slot aperture 60 in the slot 42. The illustrated fastener 56 includes a bolt that extends through the slot aperture 60 and the leg aperture 58, with a nut being disposed in the leg 50. In other embodiments, the fastener 56 may be a press-fit, a screw, or the like. Rotating the fastener 56 correspondingly adjusts a position of the hook portion 54 between the first distance D1 and the second distance D2. For example, rotating the fastener 56 clockwise moves the hook portion 54 toward the first distance D1, while rotating the fastener 56 counterclockwise moves the hook portion 54 toward the second distance D2. Therefore, the hook portion 54 may be disposed at any position between the first distance and the second distance.

The mounting base 14 further includes a front aperture 62 (shown in FIG. 1B) disposed on each front hook 40 to allow a user to access and adjust the corresponding fastener 56. Specifically, the front aperture 62 is sized such that a socket wrench, screwdriver, or similar tool may be inserted into the front aperture 62. Once inserted into the front aperture 62, the tool may tighten or loosen the fastener 56. In other embodiments, the fastener 56 may be readily accessible by the user without the use of tools. For example, the fastener 56 may include a thumbscrew or knob that allows the user to tighten or loosen the fastener 56 with solely a user's hand. In other embodiments, the rear hooks 46 may be spring-loaded. In such embodiments, the rear hooks 46 may be constantly biased toward the front hooks 40. A user may temporarily spread the rear hooks 46 apart from the front hooks 40 against the bias to attach the stadium seat 10 to and remove the stadium seat 10 from the bleacher 12 (shown in FIG. 1A).

In use, the fastener 56 is rotated to adjust the position of the rear hook 46 relative to the front hook 40, as explained above. Adjusting the position of the rear hook 46 allows the stadium seat 10 to be coupled onto bleachers of different sizes. For example, the user rotates the fastener 56 counterclockwise when placing the stadium seat 10 onto the bleacher 12 to allow clearance between a surface of the front hooks 40 and a front edge of the bleacher 12 and a surface of the rear hooks 46 and a rear edge of the bleacher 12. Once a surface of the body 38 is in contact with the bleacher 12, the user rotates the fastener 56 clockwise until the surface of the front hook 40 is in contact with the front edge of the bleacher 12 and the surface of the rear hook 46 is in contact with the rear edge of the bleacher 12. In this position, the stadium seat 10 is locked onto the bleacher 12. To remove the stadium seat 10 from the bleacher 12, the fastener 56 is rotated counterclockwise until clearance is provided between the surface of the front hooks 40 and the front edge of the bleacher 12 and the surface of the rear hooks 46 and the rear edge of the bleacher 12. In some embodiments, the stadium seat 10 may be adjustable to fit bleachers having depths between about 9 inches and about 12 inches. In other embodiments, the stadium seat 10 may be adjustable to fit bleachers having depths less than 9 inches or greater than 12 inches.

Figure 14:
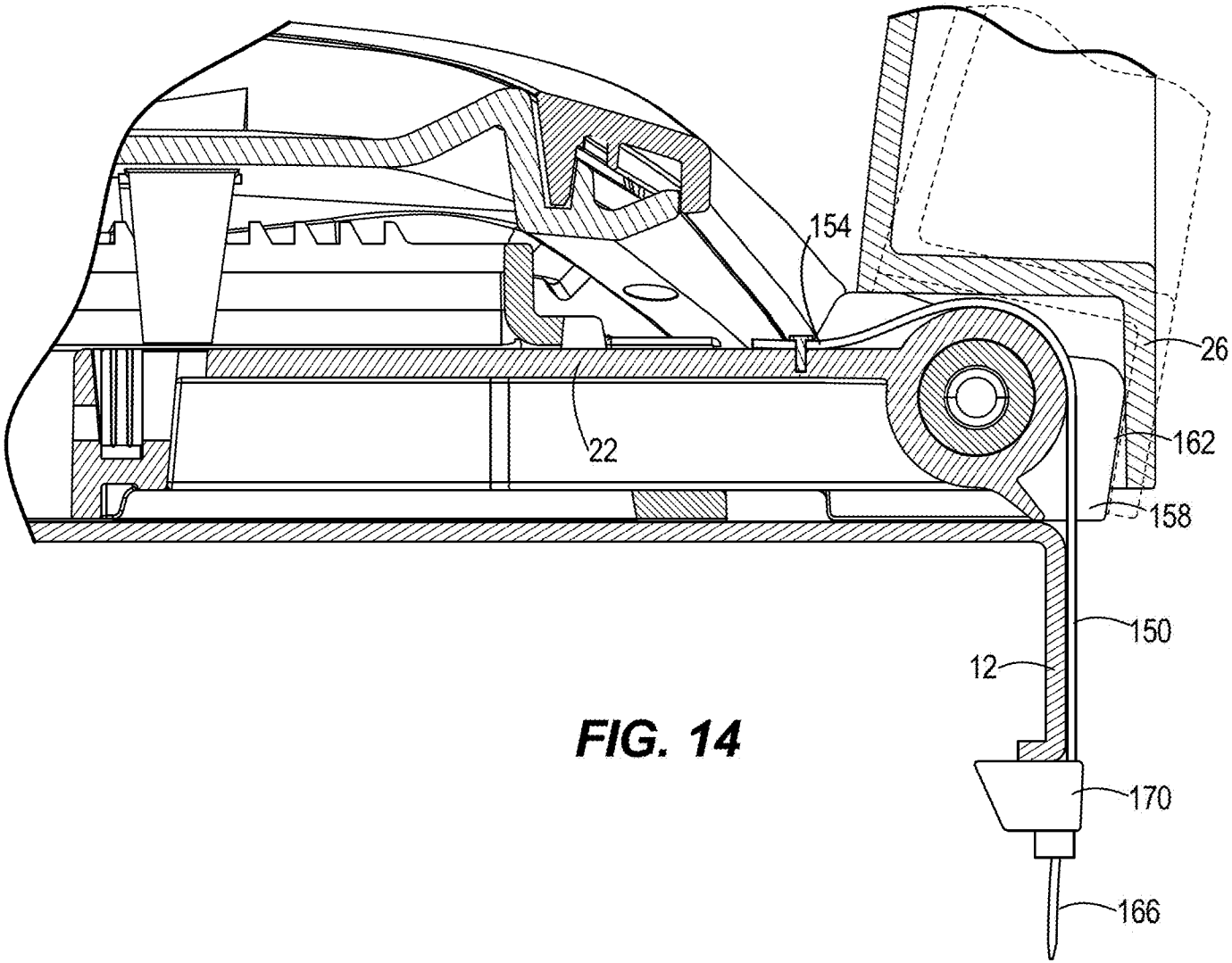
FIG. 14 is a cross-sectional view of a portion of a stadium seat according to another embodiment of the invention.

In some embodiments, space limitations may not allow room for the rear hooks 46. For example, the bleacher 12 may be mounted to a vertical structure such that there is not space for the rear hooks 46 to wrap around the bleacher 12. In such embodiments, the rear hooks 46 may be omitted, and straps 150, such as nylon zip ties, may connect the seat support 22 to the bleacher 12 (as shown in FIG. 14). The straps 150 include teeth disposed along a surface of the straps 150. A first end 154 of the strap 150 is fastened to the seat support 22. The strap 150 runs through a slot 158 that is provided between spacers 162 positioned at a rear of the seat support 22. The spacers 162 are configured to limit rotation of the back support 26 such that the back support 26 does not come into contact with the vertical structure. In other embodiments, the back support 26 and/or the spacers 162 may be omitted. A second end 166 of the strap 150 is engageable with a mounting block 170. The mounting block 170 includes a ratchet that interacts with the teeth on the strap 150. Once the mounting block 170 is pulled onto the second end 166 of the strap 150, the ratchet prevents the mounting block 170 from being removed from the strap 150. In other words, the mounting block 170 can solely move toward the seat support 22. To remove the mounting block 170 from the strap 150, a button is pressed to disengage the ratchet from the teeth. Once the ratchet is disengaged, the mounting block 170 may be pulled off the strap 150.

During installation of the seat support 22 onto the bleacher 12, the mounting block 170 is removed from the strap 150 such that the strap 150 may fit between the bleacher 12 and the vertical support. Once the strap 150 is disposed on a side of the bleacher 12 opposite to a side of the bleacher 12 on which the seat support 22 is disposed, the mounting block 170 is slid onto the strap 150. In this position, a top surface of the mounting block 170 is in contact with the bleacher 12, holding the seat support 22 onto the bleacher 12. To remove the seat support 22 from the bleacher 12, the button on the mounting block 170 is pressed and the mounting block 170 is pulled from the strap 150. Once the mounting block 170 is removed, the strap 150 may slide between the bleacher 12 and the vertical structure, allowing the seat support 22 to be removed from the bleacher 12.

With reference to FIGS. 4A-4D, the seat support 22 is movably coupled to the body 38 to allow a distance between the seat support 22 and the back support 26 to be adjusted. The illustrated seat support 22 includes a front claw 66 and a back claw 70 extending from a bottom surface 72 of the seat support 22. The front and back claws 66, 70 extend through a slot 74 disposed in the body 38 such that the front and back claws 66, 70 inhibit the seat support 22 from being entirely removed from the mounting base 14. More specifically, the slot 74 is disposed along a seat mount 76 on the body 38. The seat mount 76 is raised such that the seat support 22 sits on the seat mount 76, rather than a surface of the body 38. The front and back claws 66, 70, and therefore the seat support 22, are movable along the slot 74 such that the seat support 22 is movable to different positions relative to the mounting base 14. The front claw 66 extends from the bottom surface 72 a first distance, and the back claw 70 extends from the bottom surface 72 a second distance, the first distance being less than the second distance. In other words, the front claw 66 is shorter than the back claw 70. The front claw 66 interacts with an inner surface 76 of the body 38, such that the front claw 66 inhibits a front portion 78 of the seat support 22 from being lifted from the mounting base 14. A space 80 is provided between the back claw 70 and the inner surface 76 of the body 38, such that the back claw 70 allows a back portion 82 of the seat support 22 to be lifted a small distance from the mounting base 14. The distance corresponds with a length of the space 80 between the back claw 70 and the inner surface 76. In other embodiments, the front portion 78 may be lifted from the mounting base 14 while the back portion 82 may be inhibited from being lifted from the mounting base 14.

Figure 4A:
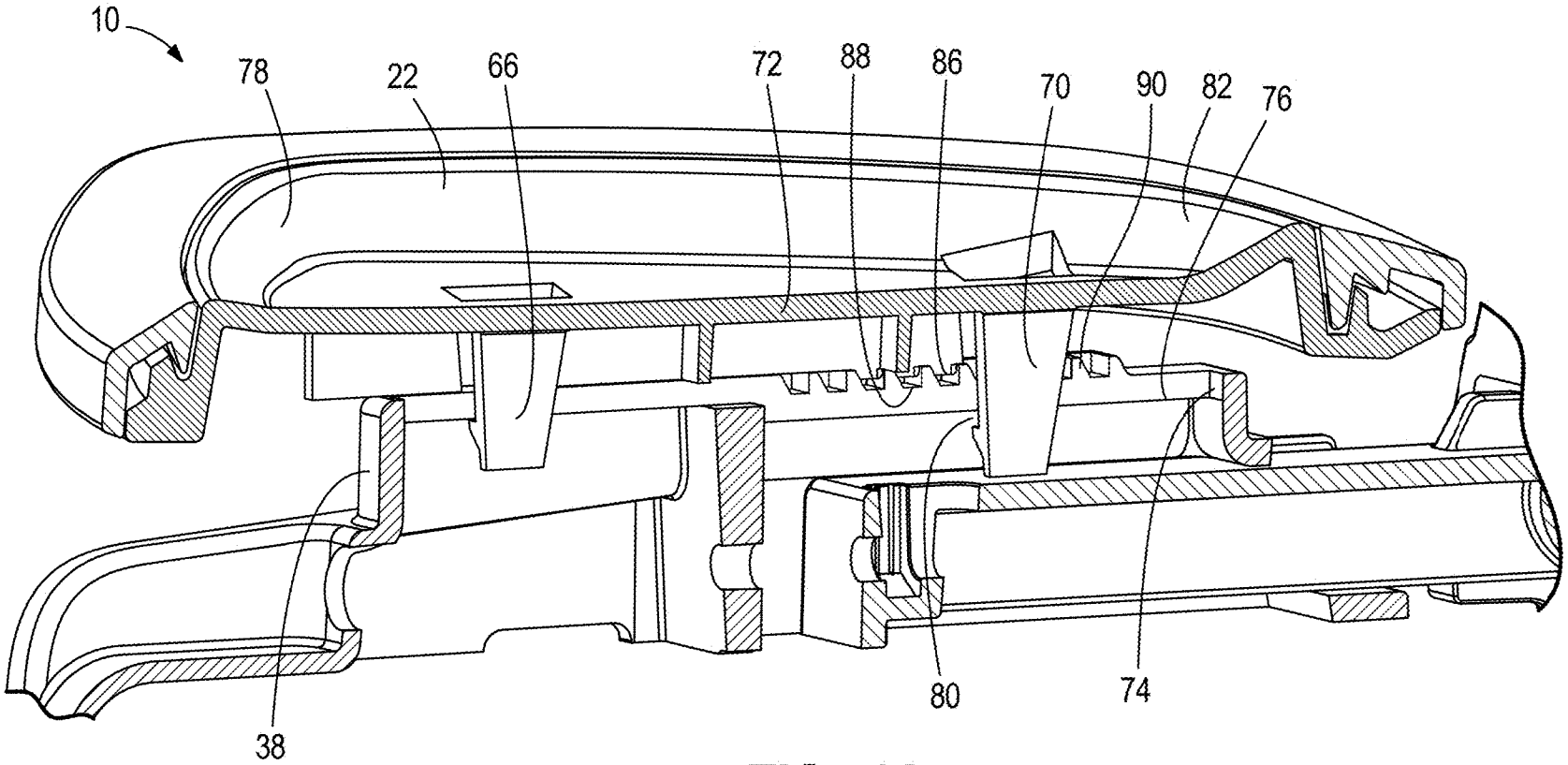
FIG. 4A is a cross-sectional, perspective view of the stadium seat taken along section line 4A-4A of FIG. 1B in a lowered position.
Figure 4B:
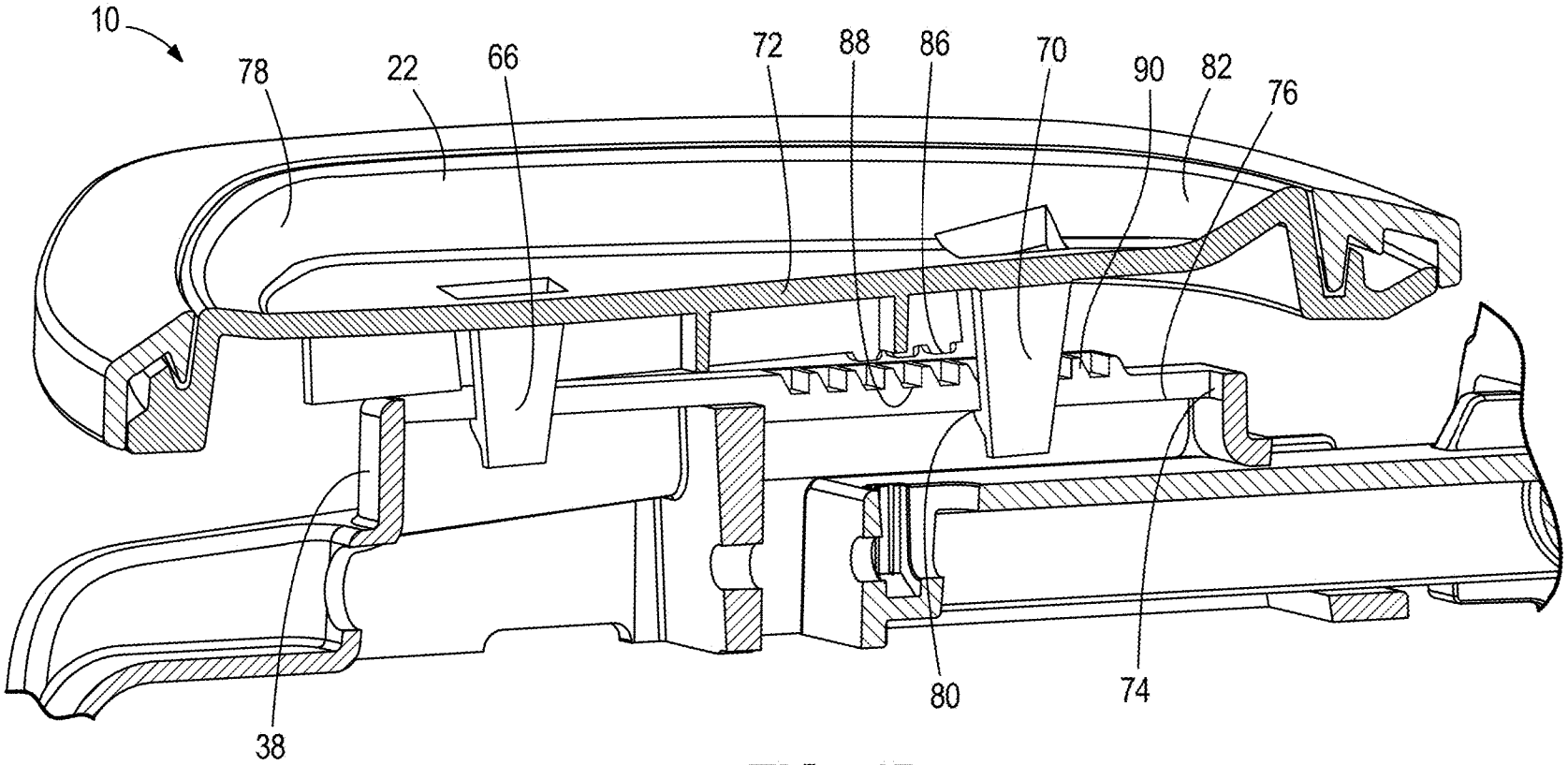
FIG. 4B is a cross-sectional, perspective view of the stadium seat taken along section line 4A-4A of FIG. 1B in a raised position.
Figure 4C:
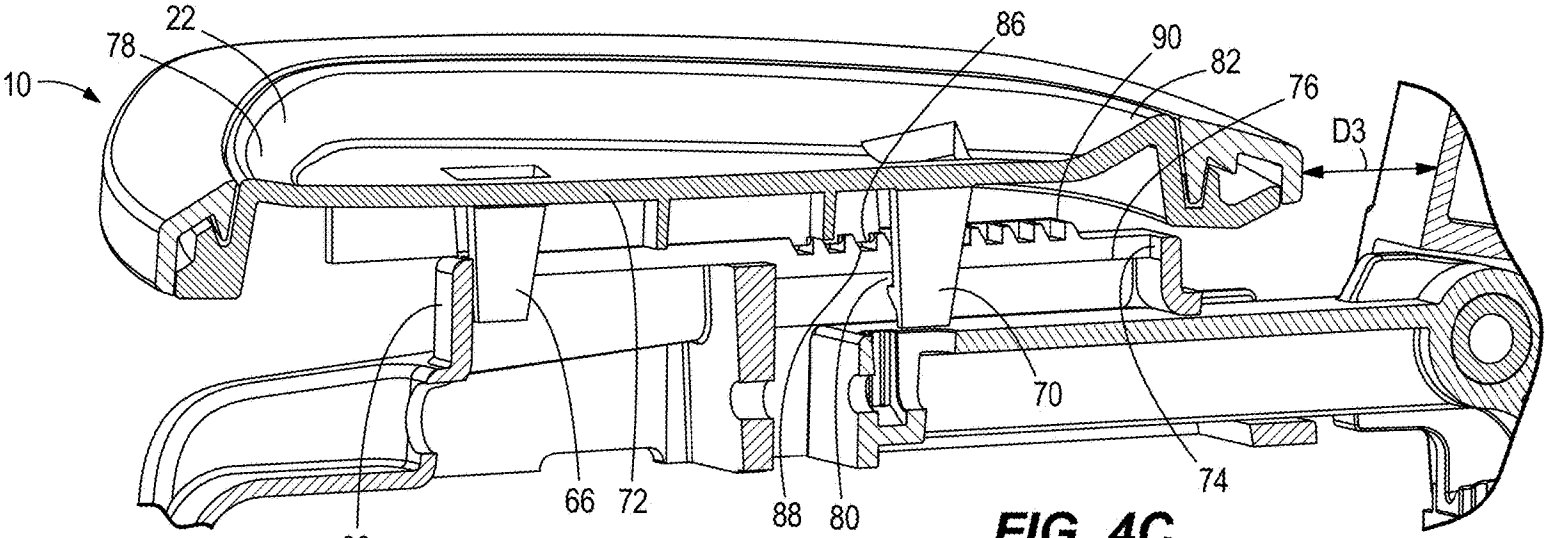
FIG. 4C is a cross-sectional, perspective view of the stadium seat taken along section line 4A-4A of FIG. 1B in a forward position.
Figure 4D:
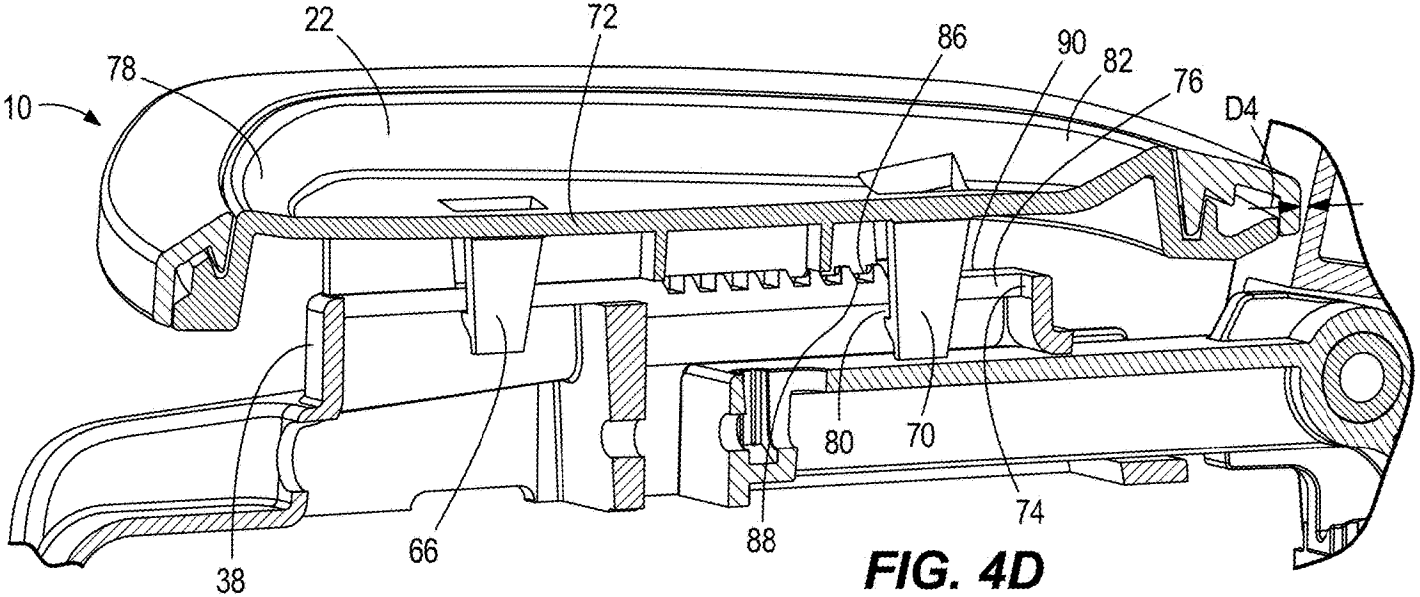
FIG. 4D is a cross-sectional, perspective view of the stadium seat taken along section line 4A-4A of FIG. 1B in a rearward position.

The seat support 22 further includes a top tooth 86 extending from the bottom surface 72 of the seat support 22. The top tooth 86 is configured to interact with spaces 88 between bottom teeth 90 positioned on the seat mount 76 the body 38, as shown in FIG. 4A. The top tooth 86 may be received in any of the spaces 88 between the bottom teeth 90. The bottom teeth 90 are ramped to inhibit the top tooth 86 from unintentionally being dislodged from the space 88. To move the top tooth 86 to an alternative space, the back portion 82 of the seat support 22 is lifted away from the mounting base 14. Lifting the back portion 82 moves the top tooth 86 away from the bottom teeth 90, allowing the top tooth 86 to move along the bottom teeth 90, as shown in FIG. 4B. Once lifted, the user moves (e.g., slides) the seat support 22 away from or toward the vertical supports 18 such that the front and back claws 66, 70 move along the slot 74. Once the seat support 22 reaches a desired position, the back portion 82 is lowered, allowing the top tooth 86 to be received in one of the spaces 88 between the bottom teeth 90.

The seat support 22 is movable between a forward position (shown in FIG. 4C) and a rearward position (shown in FIG. 4D), and positions therebetween. In the forward position, the seat support 22 is at a third distance D3 from the vertical supports 18. In the rearward position, the seat support 22 is at a fourth distance D4 from the vertical supports 18, with the fourth distance D4 being greater than the third distance D3. Moving the seat support 22 between the forward position and the rearward position allows users of different sizes to comfortably sit in the stadium seat 10. For example, a smaller user may prefer the seat support 22 to be in the rearward position, while a larger user may prefer the seat support 22 to be in the forward position. Other users may prefer the seat support 22 to be in a position between the rearward position and the forward position.

Figure 5:
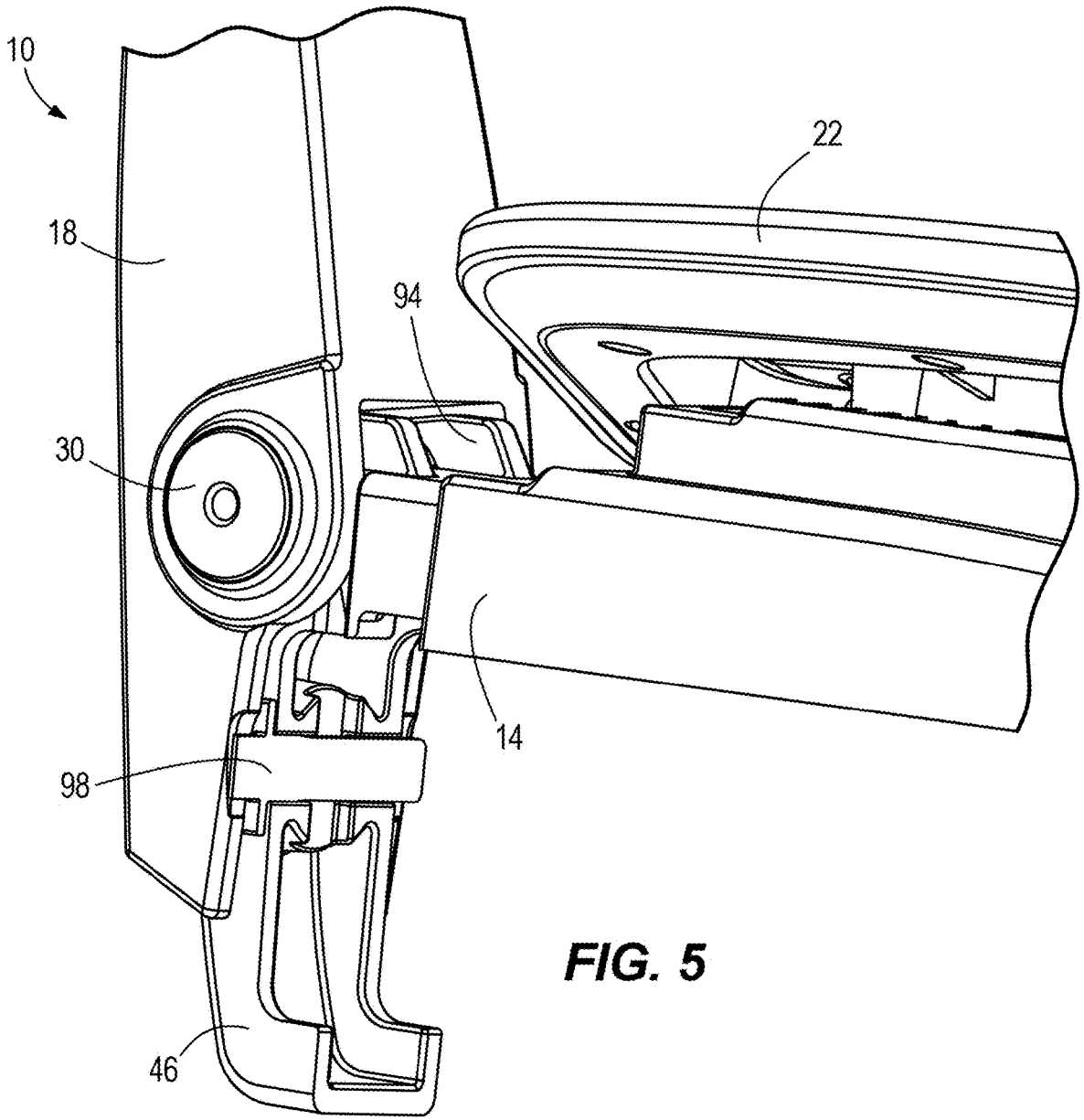
FIG. 5 is a side perspective view of a portion of the stadium seat of FIG. 1B.
Figure 6:
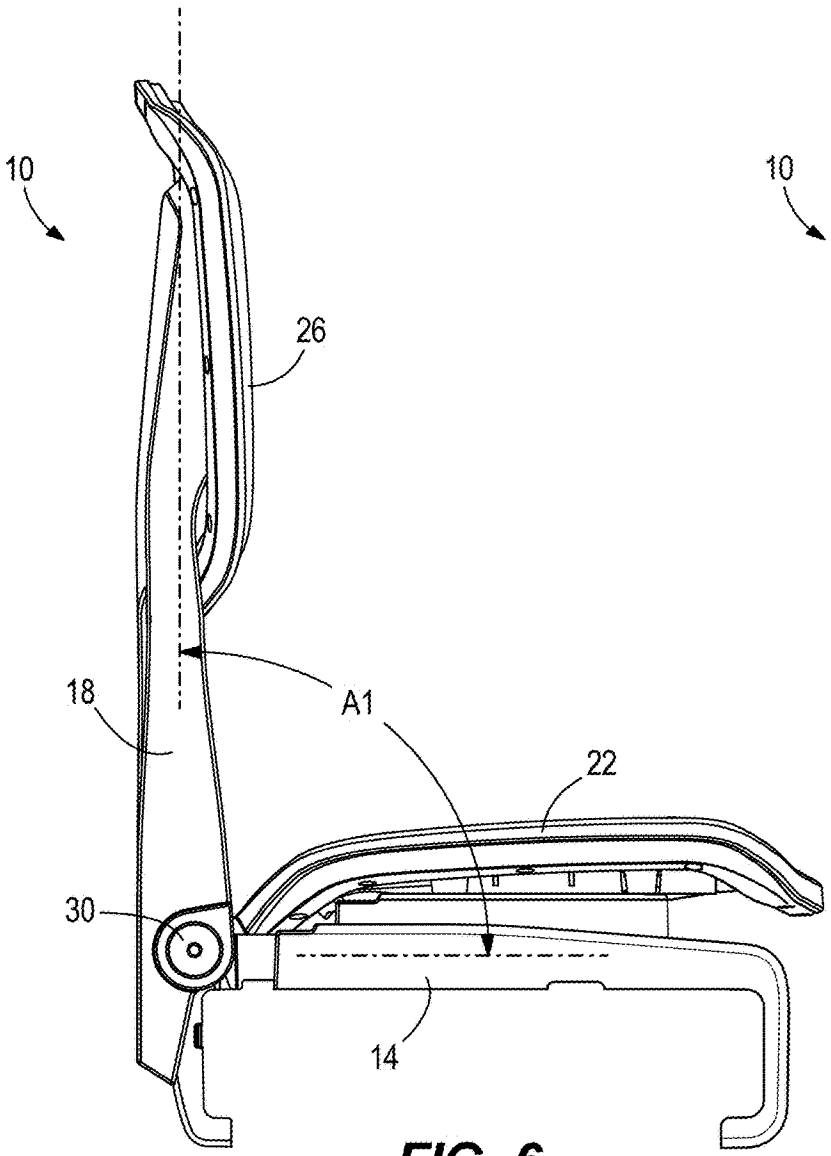
FIG. 6 is a side view of the stadium seat of FIG. 1B in a neutral position.

With reference to FIGS. 3A and 5, the vertical supports 18 are coupled to the mounting base 14 via the pins 30 such that the vertical supports 18 are pivotable or rotatable relative to the mounting base 14. Elastic members 92, or biasing members, are provided in the mounting base 14 proximate each of the vertical supports 18 to push the vertical supports 18 toward a neutral position, as shown in FIG. 3A. The illustrated elastic members 92 are springs located in pockets between each vertical support 18 and the corresponding rear hook 46. In other embodiments, the elastic members may be integral springs, torsion springs positioned on the pins 30, or the like. Neutral stops 94 are provided on the mounting base 14 to prevent the elastic members 92 from pushing the vertical supports 18 past the neutral position. In the neutral position, the vertical supports 18 are at a first angle A1 from the mounting base 14, as shown in FIG. 6. The first angle A1 is about 90 degrees from the mounting base 14. In other embodiments, in the neutral position, the first angle A1 may be less than or more than 90 degrees from the mounting base 14.

Figure 7:
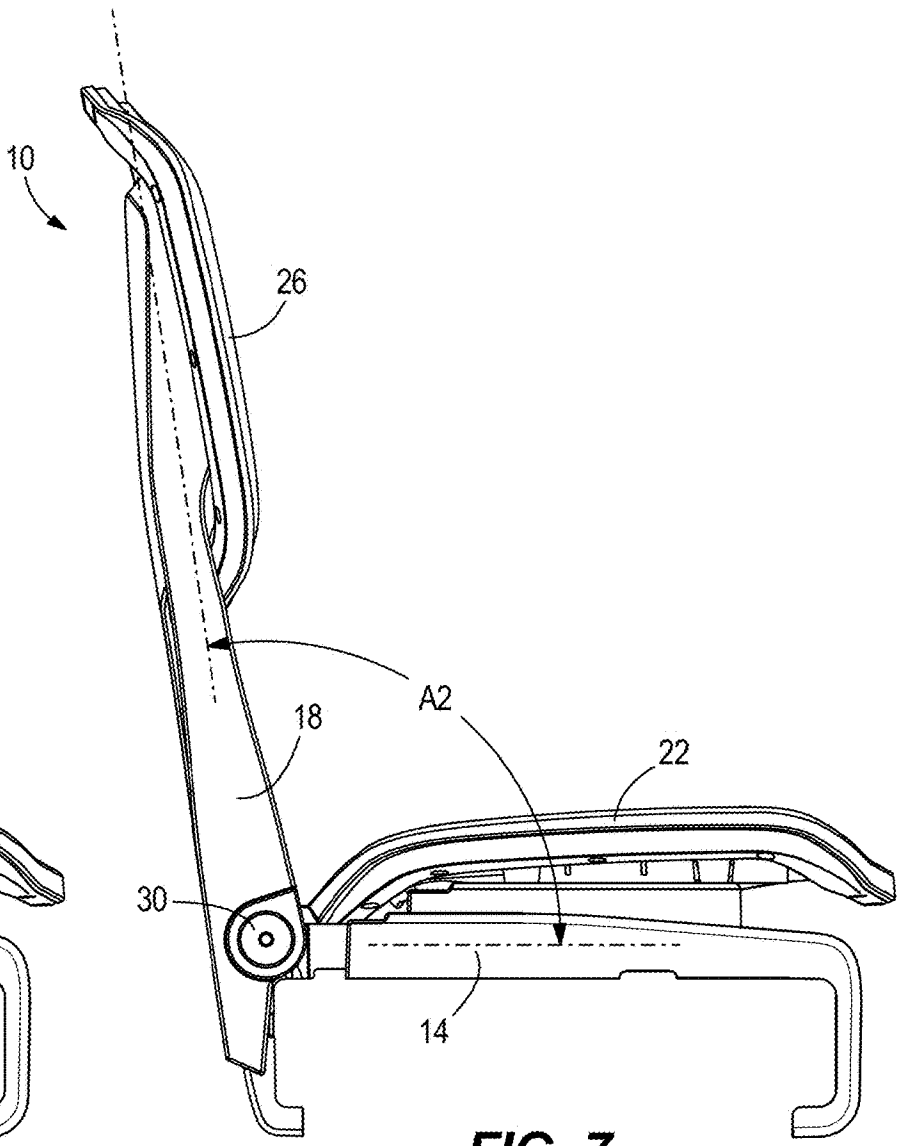
FIG. 7 is a side view of the stadium seat of FIG. 1B in a reclined position.

The mounting base 14 additionally includes incline stops 98 to inhibit rotation of the vertical supports 18 beyond a reclined position. In some embodiments, without the incline stops 98, the back support 26 may recline or tilt up to 12 degrees. In other words, the vertical supports 18 are solely rotatable between the neutral position and the reclined position. In the reclined position, in which the incline stops 98 interact with the vertical supports 18, the vertical supports 18 are at a second angle A2 from the mounting base 14, as shown in FIG. 7. The second angle A2 is at 98 degrees from the mounting base 14. In other embodiments, the incline stops 98 may be positioned to allow less than or more than 98 degrees of rotation. In further embodiments, the mounting base 14 may not include incline stops 98. In use, when the user is seated in the seat support 22 and leans back, the vertical supports 18 rotate, rotating the back support 26. When the vertical supports 18 reach the reclined position, the incline stops 98 inhibit further rotation. When the user is no longer leaning on the back support 26, the elastic members 92 return the vertical supports 18 and the back support 26 from the reclined position to the neutral position. In embodiments without the incline stops 98, the back support 26 may recline or tilt up to, for example, 12 degrees relative to the seat support 22. In embodiments, with the incline stops 98, the back support 26 may only recline or tilt up to, for example 8 degrees relative to the seat support 22.

Figure 15:
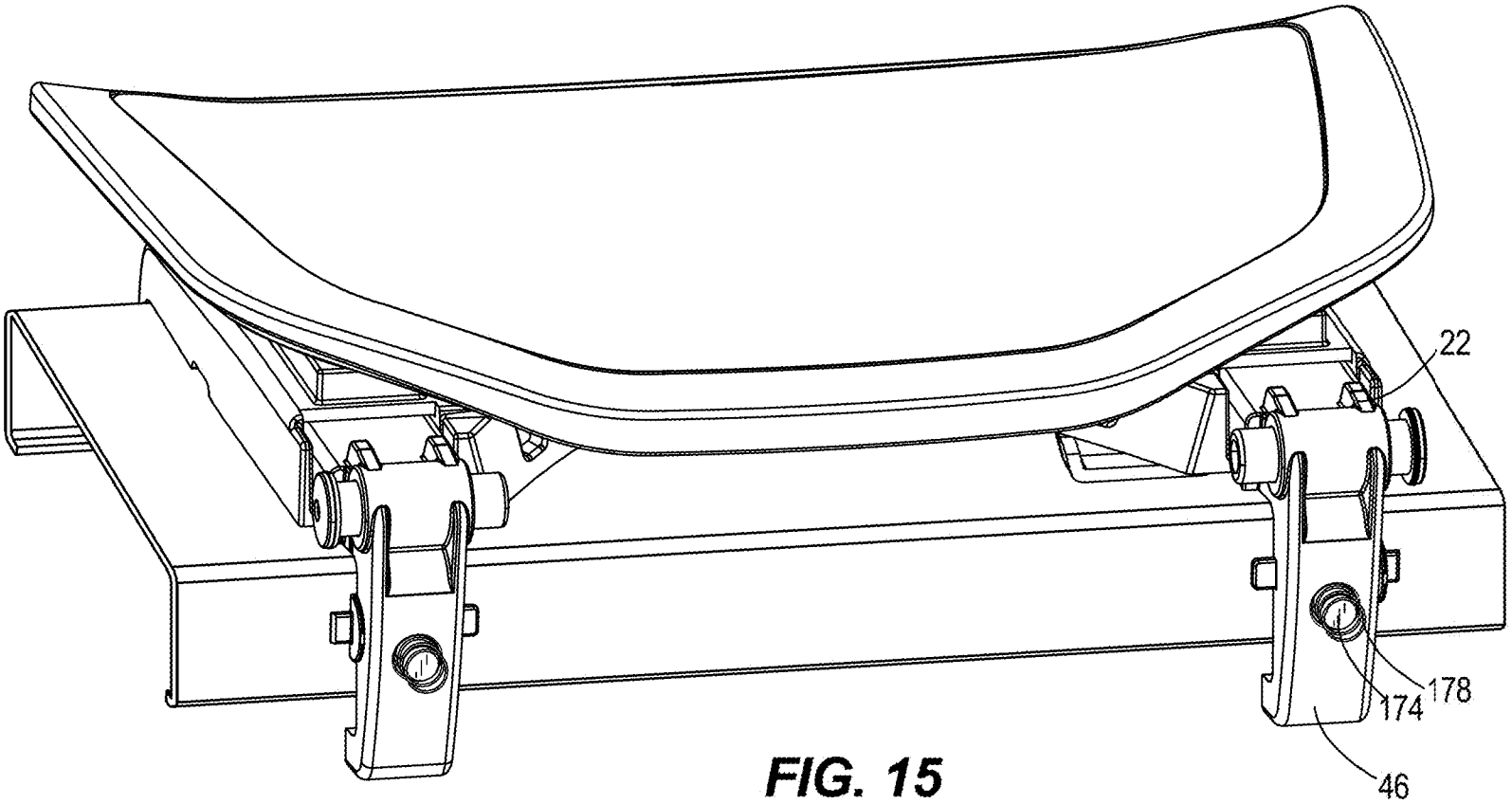
FIG. 15 is a perspective view of a stadium seat according to another embodiment of the invention.

As shown in FIG. 15, in other embodiments, the rear hooks 46 may include a dowel 174 to inhibit rotation of the vertical supports 18 beyond the reclined position. The rear hooks 46 additionally include a spring 178 disposed around the dowel 174. The dowel 174 and the spring 178 interact with the vertical support 18 such that the spring 178 pushes the vertical support 18, and therefore the back support 26, toward the neutral position and the dowel 174 prevents the vertical support 18 from passing the reclined position. A length of the dowel 174 may vary such that an angle of the reclined position may vary.

Figure 8:
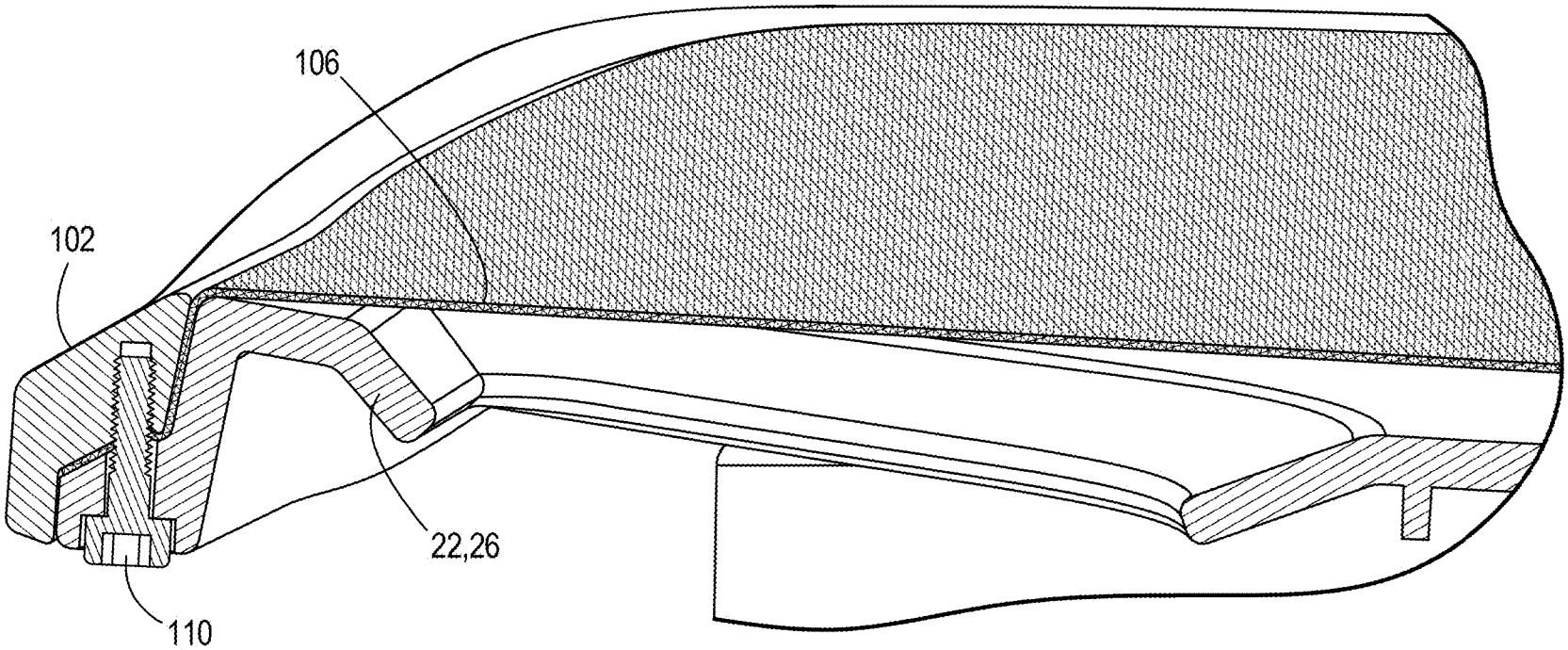
FIG. 8 is a cross-sectional view of a portion of the stadium seat of FIG. 1B.
Figure 9:
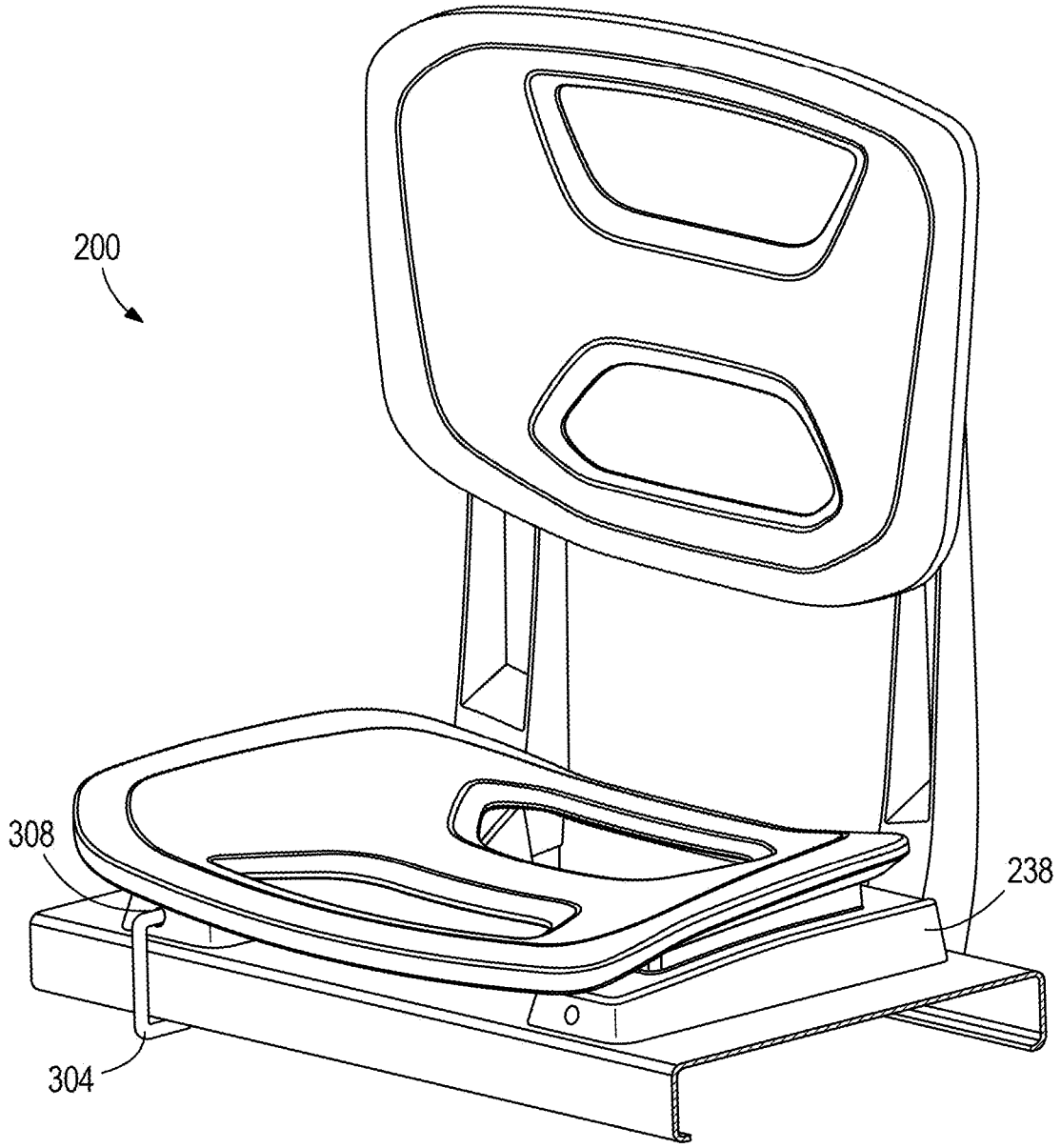
FIG. 9 is a perspective view of a stadium seat according to another embodiment of the invention.
Figure 11:
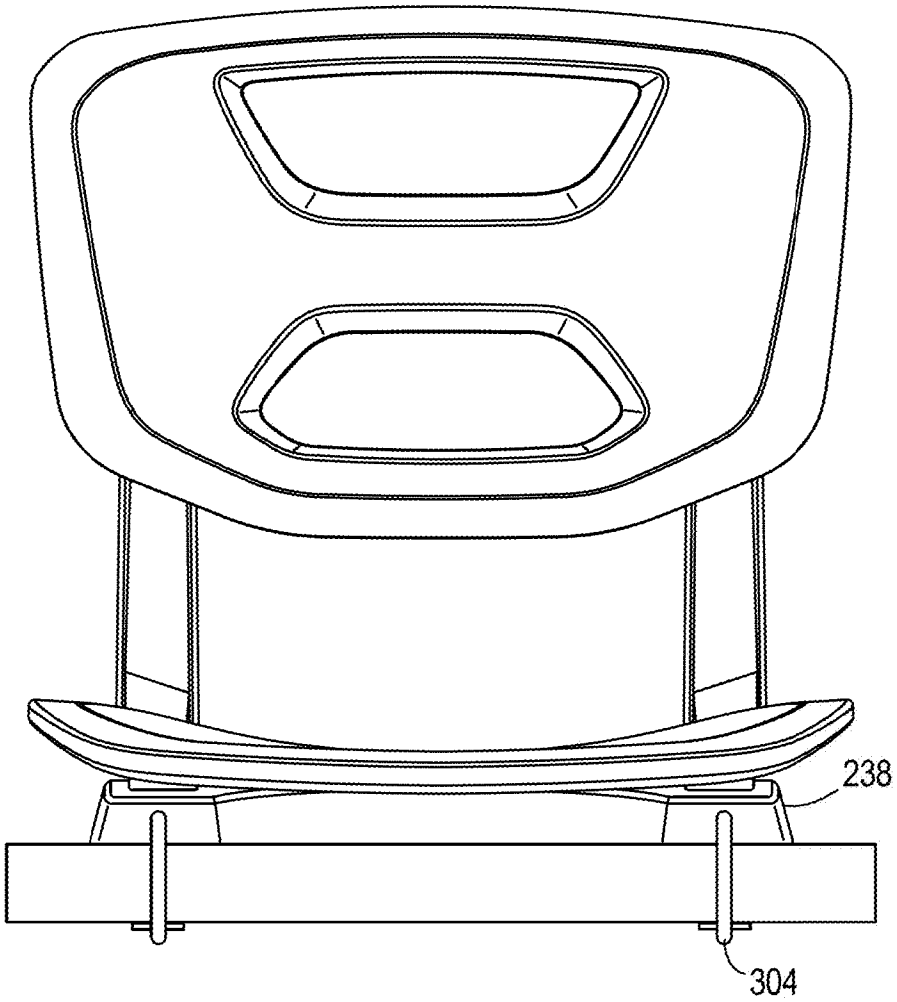
FIG. 11 is a front view of the stadium seat of FIG. 9.
Figure 10:
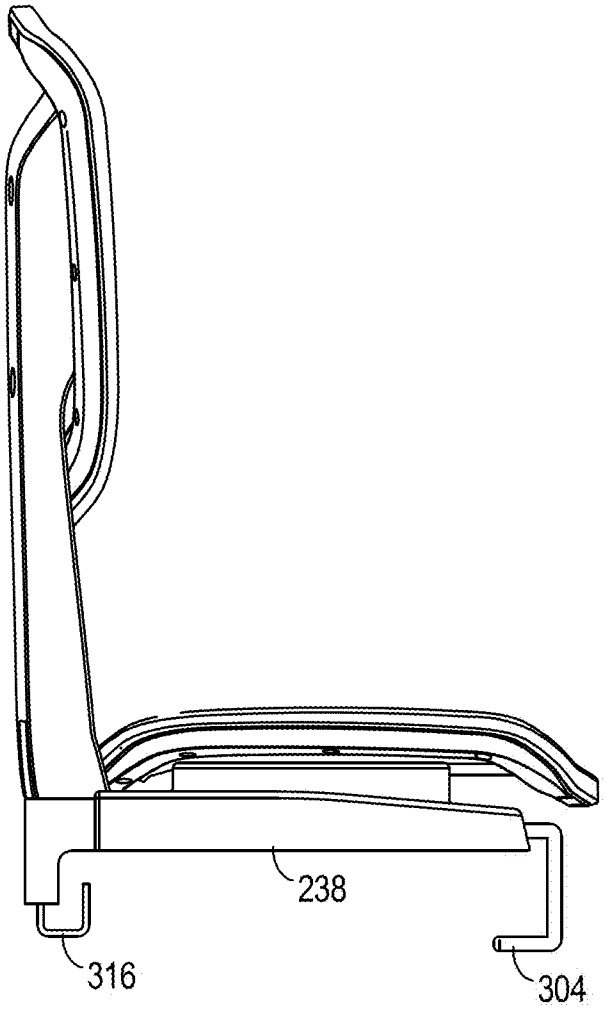
FIG. 10 is a side view of the stadium seat of FIG. 9.
Figure 13:
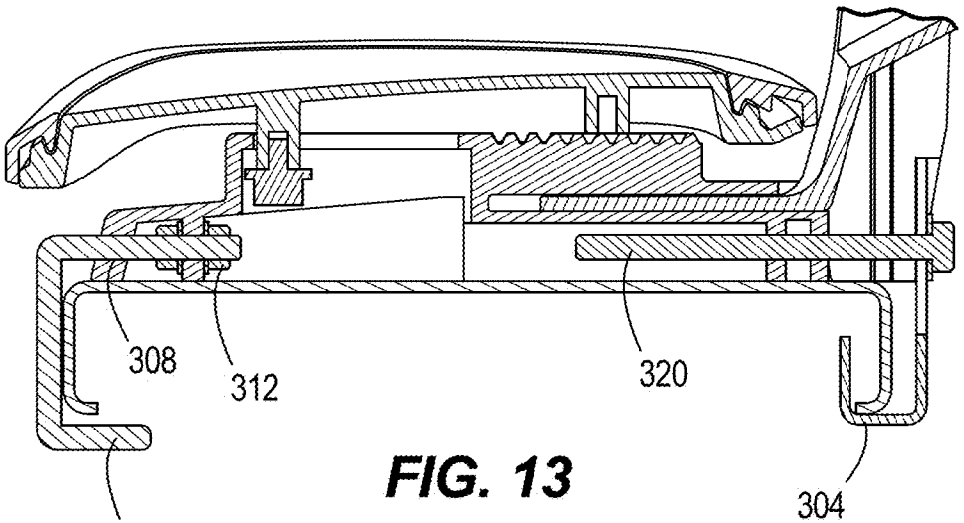
FIG. 13 is a cross-sectional view of a portion of the stadium seat of FIG. 9.
Figure 12:
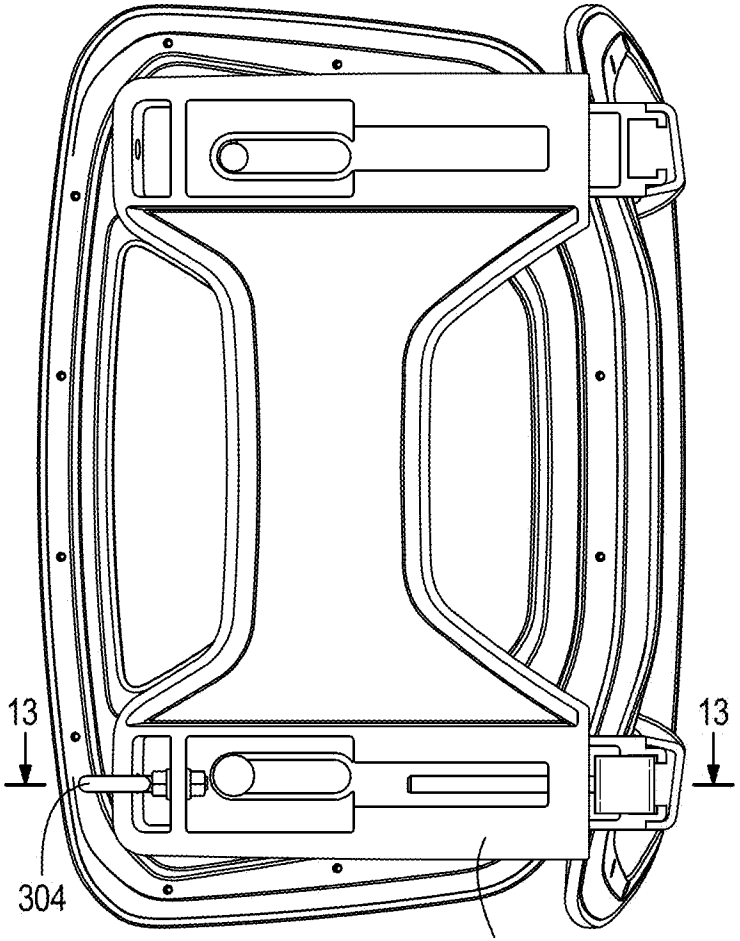
FIG. 12 is a bottom view of the stadium seat of FIG. 9.

With reference to FIG. 8, the back support 26 and the seat support 22 each include a retaining ring 102 and a material 106. Portions of the materials 106 are sandwiched between the retaining rings 102 and the back and seat supports 26, 22 such that the materials 106 are tensioned. The tension of the materials 106 provide firm support for a seated user that flexes at pressure points. The retaining rings 102 are coupled to the back and seat supports 26, 22 with fasteners 110 (e.g., screws, bolts, etc.). In other embodiments, the materials 106 may be coupled to the back and seat supports 26, 22 with snap-fits, over-molding, and the like. The materials 106 are composed of a mesh fabric that is weather resistant. For example, in some embodiments, the material 106 is a polyester yarn with PVC coating. In other embodiments, the material 106 may be a mesh having alternative mesh densities. In further embodiments, the materials 106 may be replaced by a foam pad, a molded elastomer, or the like. In such embodiments, the foam pad, molded elastomer, or the like may be attached to the seat support 22 and/or the back support 26 by different means. Additionally, the material 106 used for the back support 26 may be different than the material 106 used for the seat support 22. For example, a foam pad may be used for the seat support 22 and a mesh fabric may be used for the back support 26.

Providing the materials 106 as a mesh fabric provides a cushioned feel and breathability. The mesh fabric helps the stadium seat 10 dry after, for example, rain. Apertures formed in the seat support 22 also allow water or other liquids to drain out of the stadium seat 10. The seat support 22 is relatively solid to stop the material 106 from over-deflecting and stretching or tearing if, for example, a user stands on the seat support 22. For example, the seat support 22 may only allow the material 106 to deflect about ¾ inches before the material 106 bottoms out on the seat support 22.

With reference to FIG. 1C, the back support 26 includes a back pan 114 and the seat support 22 includes a seat pan 118. The back pan 114 is disposed between the retaining ring 102 and the back mount 36. The back pan 114 forms the apertures 37 configured to receive the barbs 35. The seat pan 118 is disposed between retaining ring 102 and the seat mount 76. The back pan 114 and the seat pan 118 each include apertures 122. The back pan 114 and the seat pan 118 each include two apertures 122. In other embodiments, the back pan 114 and the seat pan 118 may include less than two apertures 122 or more than two apertures 122. In further embodiments, one of, or both of, the back pan 114 and the seat pan 118 may not include apertures. The apertures 122 form more than 25% of the back pan 114 and the seat pan 118, respectively. In other embodiments, the apertures 122 may form less than or more than 25% of the back pan 114 and the seat pan 118. The apertures 122 reduce the weight of the back pan 114 and the seat pan 118. Additionally, the apertures 122 provide greater cooling for the materials 106 and allow for draining, while the solid areas around the apertures 122 inhibit the materials 106 from over-deflecting. Specifically, the apertures 122 provide airflow through the apertures 122 and to the materials 106.

In some embodiments, the stadium seat 10 may additionally include armrests. The armrests may extend from the vertical supports 18 or from other portions of the stadium seat 10. Each of the armrests may include padding or may be rigid plastic. Additionally, one or both of the armrests may include a cupholder. Alternatively, the cupholder may be mounted elsewhere on the stadium seat 10. Other features and accessories may additionally be included on the armrests.

In some embodiments, the stadium seat 10 may be foldable when the vertical supports 18 and the back support 26 are connected to the seat support 22. In such embodiments, the back support 26 may be folded onto the seat support 22 when the stadium seat 10 is connected to and/or disconnected from the bleacher 12. The stadium seat 10 may also include a handle, strap, or other mechanism to facilitate carrying the stadium seat 10.

In some embodiments, the stadium seat 10 may include a net, pouch, or other container to hold a user's belongings (e.g., keys, cellphone, wallet, etc.). The net or pouch may be connected to a front edge of the seat support 22. In other embodiments, the net or pouch may be located elsewhere on the stadium seat 10. The net or pouch may include a security feature (e.g., a lock) to prohibit unauthorized access to the net or pouch. The net or pouch may also be waterproof.

In some embodiments, the stadium seat 10 may be powered. For example, the stadium seat 10 may include a battery that powers a heating pad in the seat support 22 and/or the back support 26. The stadium seat 10 may also include a charging port (e.g., a USB port, etc.) that is connected to the battery. The charging port may allow a user to charge a cellphone or other portable electronic device. In other embodiments, the stadium seat 10 may include a power cord that connects to an AC power source (e.g., a wall outlet, a generator, etc.) to provide power to the heating pad and/or the charging port. In some embodiments, the stadium seat 10 may include both a battery and a power cord.

FIGS. 9-13 illustrate a stadium seat 200 according to another exemplary embodiment of the present disclosure. The stadium seat 200 is similar to the stadium seat 10 described above. As such, like parts have been given like reference numbers plus 200. In the illustrated embodiment, the stadium seat 200 includes a front hook 304 that is a separate piece from a body 238 of the stadium seat 200. The front hook 304 defines a U-shaped metal hook. The front hook 304 is received in a front slot 308 of the body 238. The front hook 304 is coupled to the front slot 308 via a fastener 312. In some embodiments, the fastener 312 may be integrally formed in the front slot 308. In other embodiments, the fastener 312 may be a separate component, for example, a screw or a bolt. The stadium seat 200 includes only one front hook 304. However, in other embodiments, the stadium seat 200 may include two front hooks 304.

The stadium seat 200 also includes a rear hook 316. The rear hook 316 defines a U-shaped metal hook. The shape of the rear hook 316 is different than the shape of the front hook 304. In other embodiments, the shape of the rear hook 316 may be the same as the shape of the front hook 304. The rear hook 316 is coupled to the body 238 via a fastener 320. The fastener 320 allows adjustment of a distance between the rear hook 316 and a bottom surface of the body 238. In other words, the fastener 320 allows the rear hook 316 to be lowered and raised relative to the body 238. The stadium seat 200 includes only one rear hook 316. In other embodiments, the stadium seat 200 may include two rear hooks 316.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A stadium seat comprising:

a mounting base configured to be connected to a support structure;

a vertical support extending upwardly from the mounting base;

a seat support movably coupled to the mounting base; and a back support coupled to the vertical support, wherein the seat support is movable relative to the mounting base between a first position, in which the seat support is at a first horizontal distance from the vertical support, and a second position, in which the seat support is at a second horizontal distance from the vertical support, the first distance being different than the second distance, and wherein a portion of the seat support is liftable away from the mounting base to move the seat support between the first position and the second position.

2. The stadium seat of claim 1, wherein the seat support includes a tooth, wherein the mounting base includes a series of teeth, and wherein the tooth of the seat support interacts with the series of teeth on the mounting base to releasably hold the seat support in the first and second positions.

3. The stadium seat of claim 2, wherein a portion of the seat support is liftable away from the mounting base to disengage the tooth of the seat support from the series of teeth on the mounting base, allowing the seat support to move relative to the mounting base.

4. The stadium seat of claim 3, wherein one of the seat support or the mounting base includes a claw, and wherein the claw engages another of the seat support or the mounting base when the seat support is lifted to inhibit separation of the seat support from the mounting base.

5. The stadium seat of claim 1, wherein the seat support includes a seat pan, a retaining ring, and a material, wherein an edge of the material is sandwiched between the retaining ring and the seat pan, and wherein the material is tensioned over the seat pan.

6. The stadium seat of claim 5, wherein the material is composed of a polyester yarn with PVC coating.

7. The stadium seat of claim 5, wherein at least a portion of the seat pan beneath the material is solid to limit deflection of the material.

8. The stadium seat of claim 1, wherein the vertical support is pivotable relative to the mounting base between a neutral position and a reclined position.

9. The stadium seat of claim 1, wherein the mounting base includes a front hook configured to engage a first edge of the support structure and a rear hook configured to engage a second edge of the support structure, and wherein the front hook and the rear hook are movable apart from each other to accommodate different sizes of support structures.

10. A stadium seat comprising:

a mounting base configured to be connected to a support structure, the mounting base including a front hook configured to engage a first edge of the support structure and a rear hook configured to engage a second edge of the support structure; and a seat support coupled to the mounting base, wherein the rear hook is movable relative to the front hook between a first position, in which the rear hook is spaced a first distance from the front hook, and a second position, in which the rear hook is spaced a second distance from the front hook, the first distance being less than the second distance, wherein the rear hook is coupled to the body via a fastener, and wherein rotating the fastener adjusts a position of the rear hook relative to the front hook, and wherein the front hook defines an aperture that is sized to receive a tool for rotating the fastener.

11. The stadium seat of claim 10, wherein the mounting base includes a body having a slot, and wherein the rear hook includes a leg that is slidably received in the slot.

12. The stadium seat of claim 10, wherein the fastener includes a bolt.

13. The stadium seat of claim 10, wherein the front hook is a first front hook and the rear hook is a first rear hook, wherein the mounting base includes a second front hook configured to engage the first edge of the support structure and a second rear hook configured to engage the second edge of the support structure, and wherein the second rear hook is also movable relative to the second front hook between the first position and the second position.

14. A stadium seat comprising:

a mounting base configured to be connected to a support structure;

a vertical support extending upwardly from the mounting base;

a seat support movably coupled to the mounting base; and a back support coupled to the vertical support, wherein the seat support is movable relative to the mounting base between a first position, in which the seat support is at a first horizontal distance from the vertical support, and a second position, in which the seat support is at a second horizontal distance from the vertical support, the first distance being different than the second distance, and wherein the seat support includes a tooth, wherein the mounting base includes a series of teeth, and wherein the tooth of the seat support interacts with the series of teeth on the mounting base to releasably hold the seat support in the first and second positions.

15. The stadium seat of claim 14, wherein a portion of the seat support is liftable away from the mounting base to disengage the tooth of the seat support from the series of teeth on the mounting base, allowing the seat support to move relative to the mounting base.

16. The stadium seat of claim 15, wherein one of the seat support or the mounting base includes a claw, and wherein the claw engages another of the seat support or the mounting base when the seat support is lifted to inhibit separation of the seat support from the mounting base.

17. A stadium seat comprising:

a mounting base configured to be connected to a support structure;

a vertical support extending upwardly from the mounting base;

a seat support movably coupled to the mounting base; and a back support coupled to the vertical support, wherein the seat support is movable relative to the mounting base between a first position, in which the seat support is at a first horizontal distance from the vertical support, and a second position, in which the seat support is at a second horizontal distance from the vertical support, the first distance being different than the second distance, and wherein the seat support includes a seat pan, a retaining ring, and a material, wherein an edge of the material is sandwiched between the retaining ring and the seat pan, and wherein the material is tensioned over the seat pan.

18. The stadium seat of claim 17, wherein the material is composed of a polyester yarn with PVC coating.

19. The stadium seat of claim 17, wherein at least a portion of the seat pan beneath the material is solid to limit deflection of the material.

20. A stadium seat comprising:

a mounting base configured to be connected to a support structure;

a vertical support extending upwardly from the mounting base;

a seat support movably coupled to the mounting base; and a back support coupled to the vertical support, wherein the seat support is movable relative to the mounting base between a first position, in which the seat support is at a first horizontal distance from the vertical support, and a second position, in which the seat support is at a second horizontal distance from the vertical support, the first distance being different than the second distance, and wherein the vertical support is pivotable relative to the mounting base between a neutral position and a reclined position.

* * * * *